US010792680B2

(12) United States Patent
Collinson et al.

(10) Patent No.: US 10,792,680 B2
(45) **Date of Patent: *Oct. 6, 2020**

(54) MODIFIED SPRAY HEAD

(71) Applicant: Reckitt Benckiser (Brands) Limited, Slough, Berkshire (GB)

(72) Inventors: Nikki Collinson, Hull (GB); Avijit Das, Hull (GB); Scott Rudkin, Hull (GB); Anne Renée Jeanne Szklarz, Hull (GB); Christopher Witty, Hull (GB)

(73) Assignee: RECKITT BENCKISER (BRANDS) LIMITED, Slough, Berkshire (GB)

( * ) Notice: Subject to any disclaimer, the term of this patent is extended or adjusted under 35 U.S.C. 154(b) by 0 days.

This patent is subject to a terminal disclaimer.

(21) Appl. No.: 15/752,529

(22) PCT Filed: Sep. 19, 2016

(86) PCT No.: PCT/GB2016/052920

§ 371 (c)(1),
(2) Date: Feb. 13, 2018

(87) PCT Pub. No.: WO2017/046618

PCT Pub. Date: Mar. 23, 2017

(65) Prior Publication Data

US 2019/0009286 A1 Jan. 10, 2019

(30) Foreign Application Priority Data

Sep. 18, 2015 (GB) ..... GB1516549.1

(51) Int. Cl.
*B05B 1/28* (2006.01)
*B05B 15/50* (2018.01)
(Continued)

(52) U.S. Cl.
CPC ..... *B05B 1/28* (2013.01); *B05B 15/50* (2018.02); *B05B 11/3052* (2013.01); *B05B 11/3057* (2013.01); *B65D 83/26* (2013.01)

(58) Field of Classification Search
CPC ..... B05B 1/28; B05B 15/50; B05B 11/3052; B05B 11/3057; B65D 83/26
(Continued)

(56) References Cited

U.S. PATENT DOCUMENTS 4,700,890 A * 10/1987 Hasegawa ..... B05B 1/28 239/103
5,664,732 A 9/1997 Smolen, Jr. et al.
(Continued)

FOREIGN PATENT DOCUMENTS

EP 1665929 A1 6/2006
JP H0316664 A 1/1991
(Continued)

OTHER PUBLICATIONS

International Search Report and Written Opinion of the International Searching Authority for corresponding application PCT/GB2016/052920 dated Dec. 12, 2016.
(Continued)

*Primary Examiner* — Christopher S Kim
(74) *Attorney, Agent, or Firm* — Norris McLaughlin PA

(57) ABSTRACT

The invention relates to a modified spray head suitable for use with an aerosol composition.

17 Claims, 4 Drawing Sheets

(51) Int. Cl.
*B05B 11/00* (2006.01)
*B65D 83/26* (2006.01)

(58) Field of Classification Search
USPC ..... 239/103, 120–122, 601, 498
See application file for complete search history.

(56) References Cited

U.S. PATENT DOCUMENTS

| | | | | |
|---|---|---|---|---|
| 2007/0051754 | A1 | 3/2007 | Strand et al. | |
| 2014/0335278 | A1* | 11/2014 | Tait ..... | C09D 113/02<br>427/421.1 |

FOREIGN PATENT DOCUMENTS

| | | | |
|---|---|---|---|
| JP | H04322759 | A | 11/1992 |
| JP | 2004051004 | A | 2/2004 |
| NL | 1010831 | C1 | 6/2000 |
| WO | 2014046906 | A1 | 3/2014 |

OTHER PUBLICATIONS

GB Search Report for corresponding application GB1516549.1 dated Feb. 15, 2016.

* cited by examiner

MODIFIED SPRAY HEAD

This is an application filed under 35 USC 371 based on PCT/GB2016/052920, filed 19 Sep. 2016, which in turn is based on GB 1516549A filed 18 Sep. 2015. The present application claims the full priority benefit of these prior applications and herein incorporates by reference the full disclosures of these prior applications.

FIELD OF INVENTION

The present invention relates to a modified spray head (or outlet head) suitable for a device for spraying a fluid and particularly but not exclusively, to a device for spraying fluids such as fragrances, deodorising fluids and/or pest control fluids and the like. The spray head is particularly adapted for used with aqueous compressed air aerosol formulations.

BACKGROUND

Prior art devices for spraying fragrances, and/or deodorising agents and/or sanitising fluids into a room consist of a mechanically actuated arm which is periodically activated to press down on a spray head secured to an aerosol canister containing the material to be sprayed.

The prior art devices are typically constructed as follows. An outer casing has an opening through which the spray is ejected. The casing has a removable section which is removed to allow a refill canister containing the spray material to be placed in the casing. A moulded spray head, as shown in FIG. 1 is placed over the outlet stalk of an aerosol spray can. The spray head has an inlet section having an opening to be placed over the outlet stalk of the aerosol canister. The actuation arm is located over the spray head and is caused periodically to press against the spray head to cause material from the aerosol can to be ejected through the spray head out of the opening in the casing and into the surroundings. The actuator arm is either battery powered or mains powered and can be set to activate at various time intervals which, for example, may be to activate every seven minutes, every fifteen minutes or every thirty minutes, whichever is set by a user.

The devices may allow the user complete control over the timing interval of activations. Alternative the device may allow the user choice between preset timings, with a high, medium and low frequency of spray for example.

A commercial example of such a device is the Air Wick Freshmatic® device.

A problem associated with the use of these devices is the dripping of excess formulation from the spray head. This problem is exacerbated by the increasing amount of aqueous based formulations used and by the use of compressed air aerosol formulations. Aqueous solutions are harder to evaporate than most organic solvent solutions and compressed air propellants do not provide the break-up force that drives complete vapourisation that LPG (liquid petroleum gas) propellant aerosol formulations benefit from.

Environmental, regulatory and cost concerns are driving the increase in aqueous/compressed gas aerosol products. Despite their inherent drawbacks. One of which is increased droplet build-up on the end of the spray head.

These droplets may combine and build up in time to form drops big enough to drip from the spray head. This can cause staining on the surface supporting the device.

It is an objective of the present invention to attempt to overcome these problems.

STATEMENTS OF INVENTION

In an aspect of the present invention there is provided an outlet head for a spray device, the outlet head comprising:

an inlet section having an opening adapted to receive an output section of a spray material container, the opening forming a first end of a fluid channel for receiving spray material from the spray material container; and an outlet section adapted to eject spray material and forming a second end of the fluid channel for ejecting spray material to the air;

wherein the outlet section comprises an end-cap adjacent the second end of the fluid channel and wherein at least a portion of the front face of the end cap has grooves that provide a wicking effect.

In a further aspect the grooves on the end-cap have no effect on the spray pattern from outlet head.

In a further aspect the grooves on the end-cap front face form a symmetrical pattern around the second end of the fluid channel.

In a further aspect the end-cap has a front face that is essentially planar and perpendicular to the direction of the second end of the fluid channel.

In a further aspect the end cap front face is essentially circular in shape and wherein the second end of the fluid channel is located at the centre of the circle.

In a further aspect the front face of the end cap is convex in profile and wherein the second end of the fluid channel is located at the most raised section of the convex profile of the end-cap.

In a further aspect at least a portion of the end cap front face has a highly hydrophilic surface to discourage droplet formation.

In a further aspect the portion of highly hydrophilic surface is coincident with the portion that is covered with grooves.

In a further aspect the entire front face of the end-cap has a highly hydrophilic surface.

In a further aspect the front face of the end-cap further comprises ribs that may collect and retain moisture droplets.

In a further aspect the ribs are symmetrically arranged around the second end of the fluid channel.

In a further aspect the ribs are located below the second end of the fluid channel.

In a further aspect the outlet head is designed for use with a trigger spray aerosol device.

In a further aspect the outlet head is designed for use with an automatic aerosol spray device.

In a further aspect the outlet head is an actuator designed for use with a compressed air aerosol spray device.

DETAILED DESCRIPTION OF THE INVENTION

Aerosol formulations are widely used to disperse active ingredients into the air or onto a surface to be treated.

Figure 1:
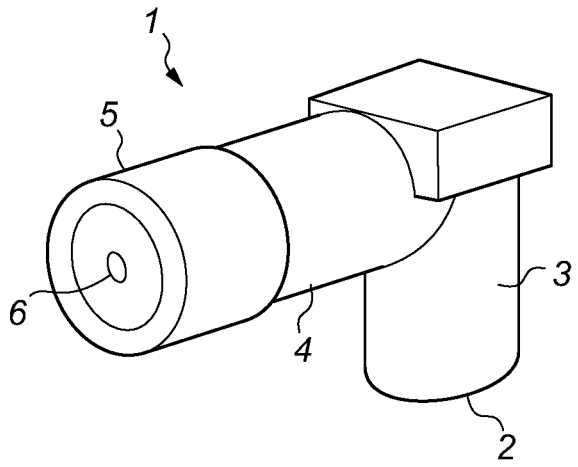
Figure 1 (PRIOR ART)
FIG. 1 illustrates a spray head of the art. Particularly one designed for use with an aerosol container and further particularly designed for use in an automatic aerosol dispenser device, such as Air Wicks Freshmatic® device.
Figure 2:
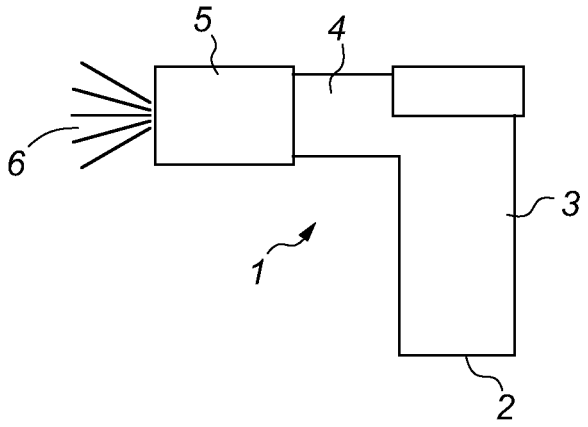
Figure 2 (PRIOR ART)
FIG. 2 shows a profile view of the spray head of FIG. 1.

FIGS. 1 and 2 show a well-known type of spray head used for aerosol formulations delivered by automatic dispensing devices. For example, the well-known FreshMatic® devices and refills from the Air Wick® brand.

For the purposes of the present invention the terms "spray head", "outlet head" and "actuator" may be considered to be interchangeable. The actuators may have further internal technical features desirable for good spray performance.

The valve stem for the aerosol canister can be inserted into opening 2 of inlet section 3. The fluid channel passes through the spray head via an outlet section 4 including an end-cap 5 to emerge at opening/spray outlet 6. The fluid generally exits the spray head at right angles to the valve stem and this is usually in a horizontal direction as the aerosol canisters are inserted vertically into the automatic dispensing devices.

These prior art spray heads work very efficiently with normal aerosol formulations that utilise liquefied gaseous propellants, such as butane. These formulations disperse very readily into the air due to the vaporisation of the liquefied propellants and leave little trace or residues.

The use of liquefied gas propellants is increasingly undesirable, both in economic and environmental terms. There is an increasing drive to replace these formulations with compressed air aerosol formulations.

However the switch is not without significant technical challenge, requiring modifications not only to the formulations themselves but to the valves and actuators (spray heads) to compensate for the different pressures and modes of action. The compressed air is not dispersed within the formulation to be dispensed (as the LPG propellants are) but may be contained within a bag in the canister or simply sits above the formulation.

Without the liquefied gas propellants the applicants have found that the aerosol compositions are not as readily dispersed and form much bigger particle/droplet sizes.

Over time and multiple sprays this can build up liquid on the spray heads. This then forms droplets that can fall from the spray head onto the surface the devices are standing on.

These droplets can cause staining to those surfaces as particularly fragrance compositions can comprise aggressive chemical components.

Figure 3:
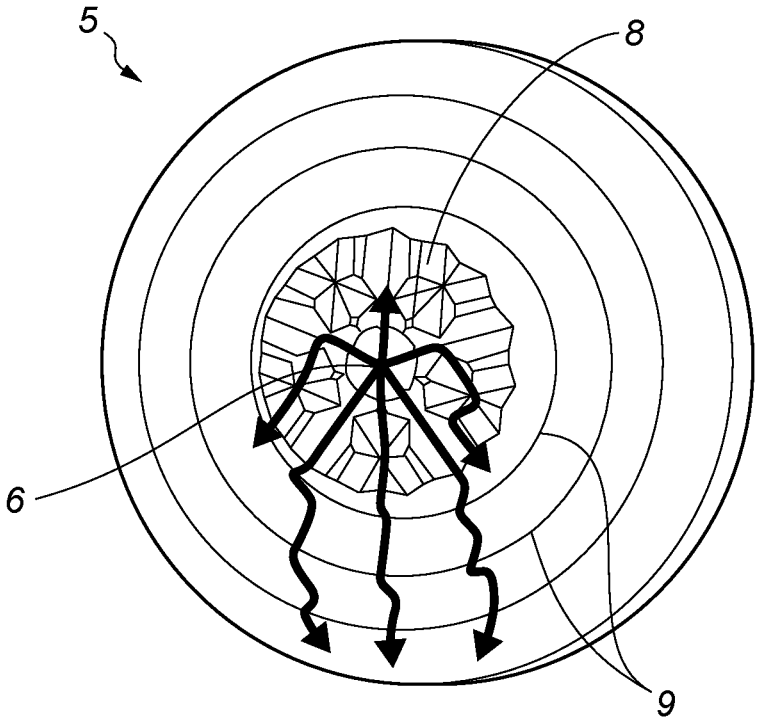
FIG. 3 illustrates a front face of an end-cap of a spray head of the present invention showing grooves for wicking liquid residues.
Figure 4:
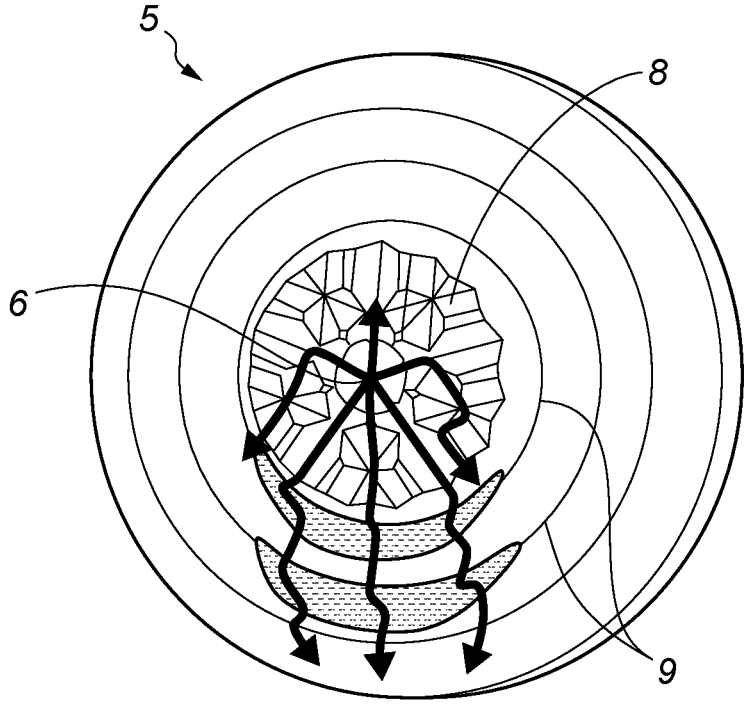
FIG. 4 illustrates an alternative view of the spray head depicted in FIG. 3 showing how rib features may retain liquid droplets and grooved section may.
Figure 5:
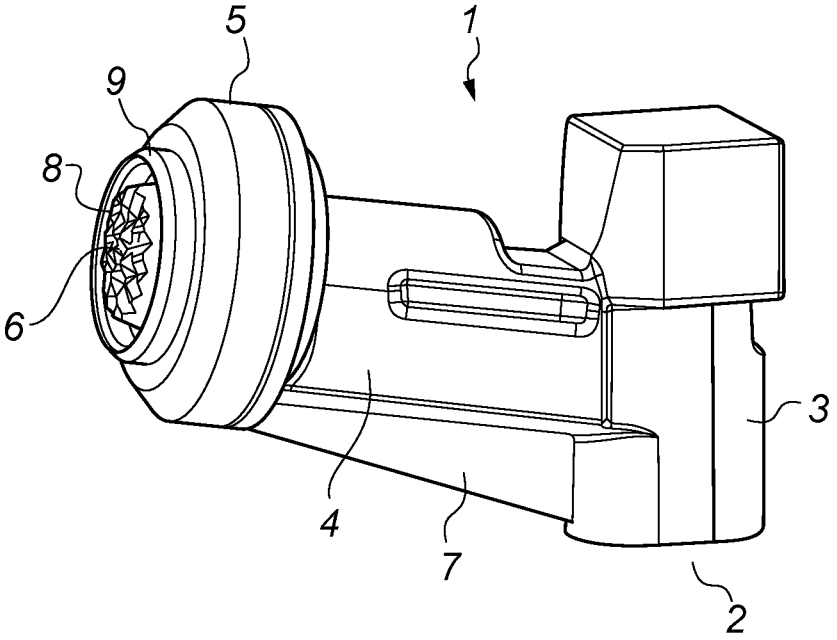
FIG. 5 illustrates a complete spray head of the present invention showing an end-cap with grooves and ribs.

FIG. 5 illustrates a spray head of the present invention which is designed to over-come this problem. FIGS. 3 and 4 illustrate a close up on the front face of the endcaps of spray heads of the present invention.

The invention comprises modifications to the front surface of the end-caps 5 of the spray heads.

The present invention is not limited by the size and shape of end-cap 5 used on the spray head. Any shape or profile of end-cap will work.

Particularly preferred profiles are round, more preferably circular or oval. The surface shape of the endcap is not limited in this invention. Preferred surface shapes of the endcaps are preferably flat or convex.

The spray heads of the present invention comprise grooves in the front face of end-cap 5, adjacent the second end of fluid channel 6. These grooves are designed to wick fluids remaining on the surface of the end-cap post spray.

The grooves help to disperse and evaporate this excess fluid prior to droplet formation.

The grooves may be between 0.1 and 5 mm deep on the surface of the end-cap. Preferably the grooves are between 0.1 and 3 mm deep, more preferably between 0.2 and 1.5 mm deep and most preferably between 0.3 mm and 1 mm deep.

The grooves may form a symmetrical pattern around the fluid exit, second end of the fluid channel 6.

For the purposes of the present invention the term "second end of the fluid channel" 6 is interchangeable the term "spray outlet" 6.

The grooves may be present in one continuous portion of the surface of the end-cap 5. Alternatively the grooves may be present in two or more distinct portions of the surface of the end-cap 5.

To aid the efficacy of the grooves it is also preferable modify at least a portion of the surface of the end cap to encourage maximum wetting. This may be achieved by making the surface more hydrophilic. The surface modification may be achieved by using a completely different material for this portion of the end-cap 5. Alternatively it may comprise a surface treatment of the material of the end-cap 5.

For the purposes of the present invention, hydrophilic means more water attracting that the surface of the material used for the remainder of the spray head.

Preferably the portion of the highly hydrophilic surface is at least coincident with the portion of the end-cap 5 that is covered with grooves 8.

Alternatively the entire front face of end-cap 5 may have a highly hydrophilic surface.

The high levels of wetting encourage dispersion and evaporation of droplets before they may fall from the spray head.

The end-cap 5 may also comprise one or more ridges 9 on its outer surface to retain moisture. Preferably these ridges 9 comprise raised portions of the surface of the end cap that prevent small droplets from moving across the surface.

There may be a single ridge 9 only. Or there may be many ridges 9. Preferably there are two or three ridges 9.

Each ridge may be continuous and completely surround the spray outlet 6. Alternatively each ridge may have gaps to allow liquids to run through.

The ridges 9 may be between 0.1 and 5 mm above the surface of the end-cap 5.

These may also be symmetrically arranged around spray outlet 6. Alternatively these may only be found below the spray outlet 6.

For the purposes of this invention "below" means in normal use. Such that gravity will move any drops from the outlet towards the ribs.

Preferably the ridges 9 may be found outside at least one portion of the grooves 8. Wherein outside is defined as further from outlet 6 than at least a portion of the grooves.

The ridges 9 may retain droplets long enough to enable them to evaporate.

In a further embodiment show in FIG. 5 the spray or outlet heads of the present invention may further comprise a droplet rib 7 positioned directly below the outlet section 4 in use. The droplet rib 7 runs from the end-cap 5 towards the inlet section 3; such that droplets forming on the bottom of the end-cap 5 are drawn down the droplet rib 7 towards the inlet section 3.

The rib may extend the entire length of the outlet section. This is the preferred embodiment. However the rib may only extend along a portion of the length of the outlet section.

The droplet rib may be between 0.1 and 3 mm wide. Preferably between 0.2 and 2 mm wide and most preferably between 0.25 and 1 mm wide. The width of the rib is measured in the horizontal plane.

The rib may have a constant height over the course of its length from end-cap to inlet section. The height of the rib is measured in the vertical plane.

Preferably the droplet rib has a height between 0.1 and 15 mm, more preferably the droplet rib has a height between 1 and 10 mm, most preferable between 1.5 and 7 mm.

In a further embodiment the rib height increases along its length, with a shorter height at the end-cap end than that at the inlet end.

The outlet heads or spray heads of the present invention may be used with any aerosol formulations. The outlet heads are particularly useful with an automatic aerosol spray device.

The outlet or spray heads of the present invention may only be suitable for use with an aerosol formulation.

A particularly preferred use of the outlet heads of the present invention is as an actuator designed for use with compressed air aerosol formulations, more preferably aqueous compressed air aerosol formulations.

The invention claimed is:

1. An outlet head configured for use with a spray material container containing a spray material and a propellant, the outlet head comprising:

an inlet section having an opening configured to receive a valve stem of the spray material container, said opening forming a first end of a fluid channel for receiving the spray material from the spray material container; and an outlet section adapted to eject the spray material and forming a second end of the fluid channel for ejecting the spray material therefrom;

an end-cap surrounding the second end of the fluid channel and wherein at least a portion of a front face of the end cap has grooves that provide a wicking effect to any spray material remaining on the front face of the end-cap, subsequent to ejection of the spray material from the second end of the fluid channel and, a droplet rib positioned directly below the outlet section, the droplet rib spanning from a rear of the end-cap to the inlet section whereby, droplets of spray material forming on a bottom of the end-cap are drawn down the droplet rib to the inlet section.

2. The outlet head of claim 1 wherein the grooves on the end-cap have no features which effect a spray pattern of spray material exiting from outlet head.

3. The outlet head of claim 1 wherein the grooves on the end-cap front face form a symmetrical pattern around the second end of the fluid channel.

4. The outlet head of claim 1 wherein the front face of the end-cap is essentially planar and perpendicular to the fluid channel at its second end.

5. The outlet head of claim 1 wherein the end-cap front face is essentially circular in profile and wherein the second end of the fluid channel is located at the centre of the circle.

6. The outlet head of claim 1 wherein the front face of the end-cap is convex in profile and wherein the second end of the fluid channel is located at a most raised section.

7. The outlet head of claim 6 wherein the entire front face of end-cap has a hydrophilic surface.

8. The outlet head of claim 1 wherein at least a portion of the end-cap front face has a hydrophilic surface which discourages droplet formation.

9. The outlet head of claim 8 wherein the portion of hydrophilic surface is coincident with the portion that is covered with the grooves.

10. The outlet head of claim 1 wherein the front face of the end-cap further comprises ribs configured to collect and retain moisture droplets.

11. The outlet head of claim 10 wherein the ribs are symmetrically arranged around the second end of the fluid channel.

12. The outlet head of claim 10 wherein the ribs are located below the second end of the fluid channel.

13. The outlet head of claim 1, wherein the spray material container further comprises a trigger.

14. The outlet head of claim 1 wherein the propellant of the spray material container is compressed air.

15. An outlet head configured for use with a spray material container containing a spray material and a propellant, the outlet head comprising:

an inlet section having an opening configured to receive a valve stem of the spray material container, said opening forming a first end of a fluid channel for receiving the spray material from the spray material container; and, an outlet section adapted to eject the spray material and forming a second end of the fluid channel for ejecting the spray material therefrom;

an end-cap surrounding the second end of the fluid channel and wherein at least a portion of a front face of the end-cap has grooves that provide a wicking effect to fluids remaining on the front face of the end-cap subsequent to ejection of the spray material from the second end of the fluid channel, the grooves forming a flow channel wherein the cross section of the grooves perpendicular to the flow channel have a bottom surface and two side surfaces extending therefrom.

16. The outlet head of claim 15 wherein the grooves on the end-cap front face form a symmetrical pattern around the second end of the fluid channel.

17. The outlet head of claim 15 wherein the outlet head further comprises a droplet rib positioned directly below the outlet section, the droplet rib spanning from a rear end of the end-cap to the inlet section, whereby droplets of spray material forming on a bottom of the end-cap are drawn down the droplet rib to the inlet section.

* * * * *